US007302198B2

(12) United States Patent
Ahn

(10) Patent No.: US 7,302,198 B2
(45) Date of Patent: Nov. 27, 2007

(54) DEVICE AND METHOD TO CALCULATE A CONSUMED AMOUNT OF TONER

(75) Inventor: Dong-cheol Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 215 days.

(21) Appl. No.: 11/008,171

(22) Filed: Dec. 10, 2004

(65) Prior Publication Data

US 2005/0147422 A1 Jul. 7, 2005

(30) Foreign Application Priority Data

Jan. 7, 2004 (KR) ..... 10-2004-0000961

(51) Int. Cl.
*G03G 15/08* (2006.01)

(52) U.S. Cl. ..... 399/27

(58) Field of Classification Search ..... 399/27
See application file for complete search history.

(56) References Cited

U.S. PATENT DOCUMENTS 6,810,218 B1 * 10/2004 Wong et al. ..... 399/27
2002/0141765 A1 * 10/2002 Phillips ..... 399/27

FOREIGN PATENT DOCUMENTS

JP 06-13879 5/1994
JP 10-260618 9/1998
JP 2002-244495 8/2002
JP 2002-327848 11/2002
JP 2002-328568 11/2002

OTHER PUBLICATIONS

Korean Office Action issued Jun. 19, 2006 with respect to Korean Patent Application No. 2004-00961.

* cited by examiner

*Primary Examiner*—Anjan Deb
*Assistant Examiner*—Amy He
(74) *Attorney, Agent, or Firm*—Staas & Halsey LLP

(57) ABSTRACT

An image-forming apparatus including a valid signal generator to input print data and a video clock to synchronize the print data, and generate binary image data, a pixel counter to calculate the number of pixels of the print data based on the binary image data, a data stream counter to calculate the number of particular data streams of the binary image data, a coefficient memory to store coefficients with respect to average toner consumption amounts per pixel, a weight memory to store a lookup table containing weights corresponding to percentages of the number of pixels to the particular data streams, and a controller to calculate a percentage of the number of pixels to the number of particular data streams to read out a weight, and calculate the consumed amount of toner by use of the read weight, the number of pixels, and a toner consumption amount coefficient.

18 Claims, 3 Drawing Sheets

DEVICE AND METHOD TO CALCULATE A CONSUMED AMOUNT OF TONER

CROSS-REFERENCE TO RELATED APPLICATIONS

This application claims the benefit of Korean Application No. 2004-961, filed Jan. 7, 2004 in the Korean Intellectual Property Office, the disclosure of which is incorporated herein by reference.

BACKGROUND OF THE INVENTION

1. Field of the Invention

The present invention relates to a device and method of calculating a consumed amount of toner in image-forming apparatuses such as laser beam printers which print images by the use of laser beams, and more particularly, to a device and method of more precisely calculating a consumed amount of toner in image-forming apparatuses the use of a weight depending on a consumed amount of the toner, wherein the weight is obtained based on a task mode and an image data type.

2. Description of the Related Art

In general, image-forming apparatuses such as photocopiers, printers, combination office machines, and facsimile machines print the images stored in a recording medium on a print medium, and a developer such as toner is used to print the images on the print medium.

Therefore, in general, the image-forming apparatuses have a function providing users with information on a remaining amount of toner so that a toner cartridge can be timely replaced.

The conventional method to provide the information on a remaining amount of the toner detects and notifies users of the remaining amount of toner in a toner cartridge when necessary through a toner-detecting sensor. The toner detection sensor has a light emitter and a light receiver that are installed in the toner cartridge. However, the method additionally needs a detection circuit related to the toner-detecting sensor, which increases the manufacturing cost of the image-forming apparatuses.

Another method of providing the information on a remaining amount of the toner counts the number of copies of paper just after a new toner cartridge has been installed, decides that little or no toner is remaining in the cartridge if the number of copies is over a certain number, and notifies users that little or no toner is left. However, since the method is based on the calculation under the assumption that the toner necessary to print on one sheet of paper amounts to 4 to 5% of the whole area of the sheet on average, it may happen that an amount of toner can not be enough to print as many copies as guaranteed by a toner cartridge supplier. Alternatively, on the contrary, the toner cartridge has toner left therein even after the guaranteed number of copies has been printed, depending on image patterns such as a solid pattern of black spots, or a character pattern. These patterns may be lines and characters, a halftone pattern such as graphs and drawings, and so on, which are substantially printed on the copies.

In order to solve the above and/or other problems, a method has been developed and used that calculates a consumed amount of toner by counting the number of pixels of data to be printed (hereinafter, referred to as print data) in synchronization with a video clock and multiplying a coefficient of the consumed amount of toner per pixel based on a counted value.

However, the method calculates the consumed amount of toner using only the number of pixels of the data that has been counted, which causes a problem in that the method can miscalculate the consumed amount of toner. This is because the method fails to reflect the differences between the consumed amounts of toner depending upon task modes such as a print mode, photocopy mode, and so on, and image patterns such as a solid pattern, character pattern, halftone pattern, and so on. This is due to the fringe effect even when printed copies each have the same printed area or range thereon.

For example, Table 1 as below shows a result of the applicant's experiments in which the consumed amounts of toner per pixel differ from one another depending on the task modes and printed image patterns. As shown in Table 1, the toner is most consumed for the halftone pattern in the print mode, and the toner is most consumed for the solid pattern in the lower-level photocopy mode of the copy modes.

TABLE 1

| | 5% Solid Pattern | 5% Character Pattern | 5% Halftone Pattern |
|---|---|---|---|
| Print Mode | $1.37 \times 10^{-08}$ g | $1.34 \times 10^{-08}$ g | $1.43 \times 10^{-08}$ g |
| Photocopy mode | $2.34 \times 10^{-08}$ g | $1.92 \times 10^{-08}$ g | $1.44 \times 10^{-08}$ g |

In order to solve the above and/or other problems, a method has been proposed, that uses a laser diode turn-on ratio. The ratio is calculated by counting a frequency of laser beams emitted from a laser diode by pixel as a correction coefficient when a consumed amount of toner is calculated by multiplying the counted number of pixels by a toner consumption amount coefficient.

However, the method has a problem of generating software errors due to the overload to software processing data when reading a frequency of pixels of the data to be printed.

Further, the method reads the laser diode turn-on ratios with respect to the solid pattern and the halftone pattern as values similar to each other when documents are scanned in the lower-level photocopy mode of the photocopy modes. Thus, the consumed amounts of toner for the solid pattern and the halftone pattern are calculated to have values similar to each other. Therefore, the method has a problem that the difference of the consumed amounts of toner between the solid pattern and the halftone pattern is not precisely reflected.

SUMMARY OF THE INVENTION

Accordingly, it is an aspect of the present invention to solve at least the above problems and/or disadvantages and to provide at least the advantages described below.

Accordingly, it is another aspect of the present invention to provide a device and method of calculating a consumed amount of toner in image-forming apparatuses so as to more precisely provide information on a remaining amount of the toner, wherein the consumed amount of toner is calculated by the use of a suitable weight depending on a task mode such as a print mode and a photocopy mode and image patterns such as a solid pattern, character pattern, halftone pattern and so on.

Additional aspects and/or advantages of the invention will be set forth in part in the description which follows and, in part, will be obvious from the description, or may be learned by practice of the invention.

The foregoing and/or other aspects are achieved by providing a device to calculate a consumed amount of toner in an image-forming apparatus, including a valid signal generator to input data to be printed (hereinafter, referred to as print data) and a video clock to synchronize the print data, and generate binary image data; a pixel counter to calculate a number of pixels of the print data based on the binary image data; a data stream counter to calculate the number of particular data streams of the binary image data, a particular data stream having a most significant and a least significant bit of "1" and a bit of "0"; a coefficient memory to store coefficients with respect to average toner consumption amounts per pixel; a weight memory to store a lookup table containing weights corresponding to percentages of the number of pixels relative to the number of the particular data streams; and a controller to calculate a percentage of the number of pixels relative to the number of particular data streams to read out a weight, and calculate the consumed amount of toner by use of the read weight, the number of pixels, and a toner consumption amount coefficient.

The lookup table contains weights individually calculated corresponding to an image-processing mode including one or both of a print mode and a photocopy mode, and the controller decides the image-processing mode corresponding to the current print data, applies a corresponding weight, and calculates the consumed amount of toner.

The particular data stream is any of "101" and "1001", and the weight increases in proportion to the percentage of the number of pixels relative to the particular data streams.

The data stream counter calculates the number of particular data streams based on parts of the binary image data that are spaced in a predetermined interval in order to reduce a time to calculate a ratio of the particular data streams, and the controller calculates the ratio of the particular data streams based on the parts of the binary image data spaced in an interval.

The foregoing and/or other aspects are also achieved by providing a method of calculating a consumed amount of toner in an image-forming apparatus, including storing coefficients with respect to average toner consumption amounts per pixel; storing a lookup table containing weights corresponding to percentages of a number of pixels to particular data streams, the particular data streams of binary image data each having a most significant and a least significant bit of "1" and a bit of "0", the binary image data being binary data converted from print data; inputting the print data and a video clock for synchronizing the print data, and generating the binary image data; calculating the number of pixels of the print data based on the binary image data; calculating a number of the particular data streams of the binary image data; and calculating a percentage of the number of pixels relative to the number of particular data streams to read out a weight, and calculating the consumed amount of toner with the read weight, the number of pixels, and the respective stored toner consumption amount coefficient.

The weight lookup table contains weights individually calculated corresponding to an image-processing mode including one or both of a print mode and a photocopy mode, and the toner consumption amount calculation decides the image-processing mode corresponding to the current print data, and calculates a corresponding weight.

The particular data stream is any or both of "101" and "1001", and the weight increases in proportion to the number of the particular data streams.

The calculating of the number of particular data streams includes calculating based on parts of the binary image data that are spaced in a predetermined interval. The calculating of consumed amount of toner includes calculating the percentage of the particular data streams based on the parts of the binary image data spaced in an interval.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
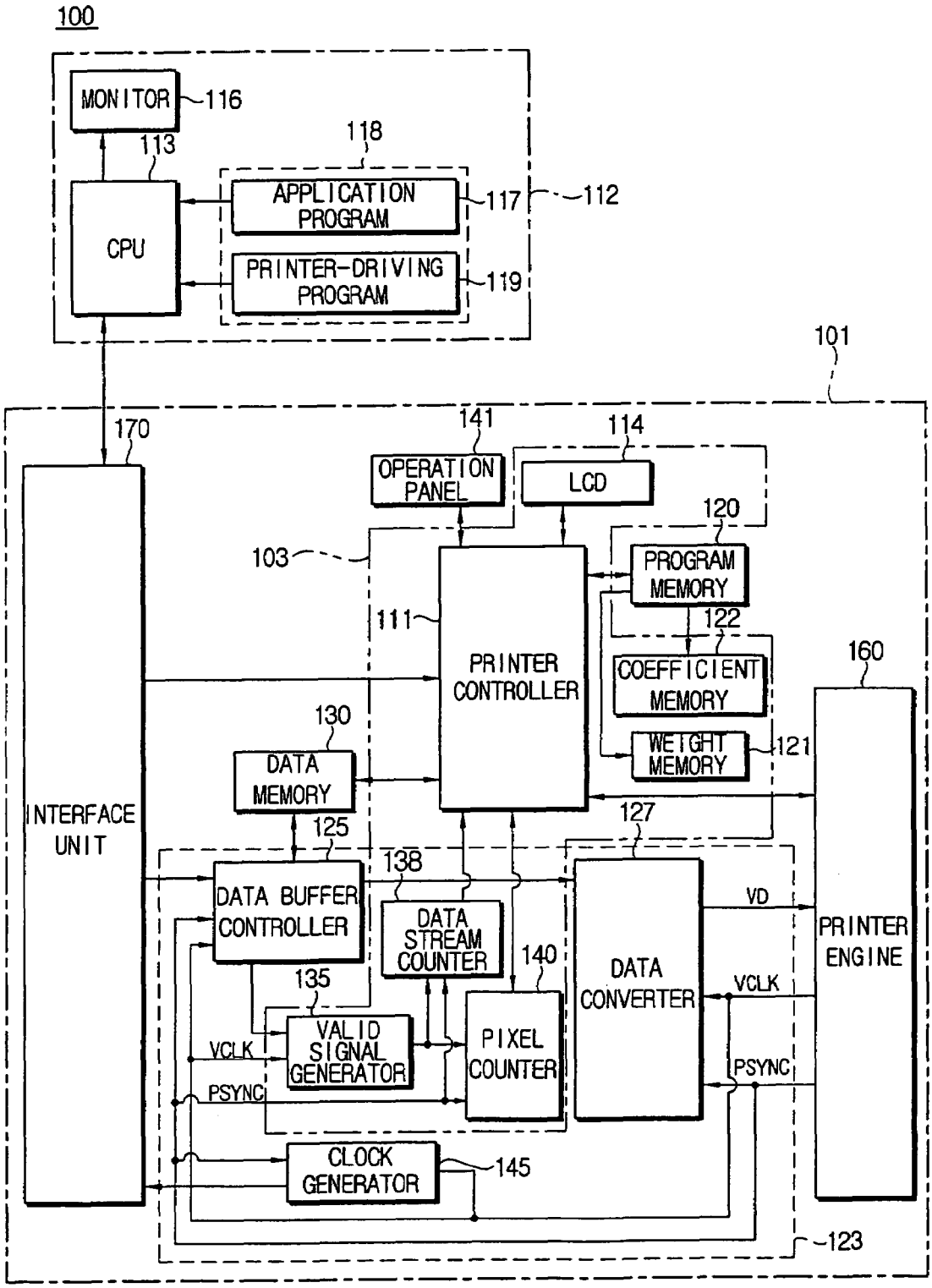
FIG. 1 is a block diagram showing a print system to which a device to calculate a consumed amount of toner according to an embodiment of the present invention.

Reference will now be made in detail to the embodiment of the present invention, an example of which is illustrated in the accompanying drawings, wherein like reference numerals refer to the like elements throughout. The embodiment is described below to explain the present invention by referring to the figures.

FIG. 1 is a block diagram of a print system to which a device to calculate a consumed amount of toner according to an embodiment of the present invention is applied. Referring to FIG. 1, a print system 100 includes a computer 112 to display data for a document created by a user on a monitor 116 and externally sending the data, and an image-forming device 101 such as a laser beam printer to internally process and print the data sent from the computer 112 through an interface unit 170.

The computer 112 has a program memory 118 to store application programs 117 to create documents and printer-driving programs 119 to drive the image-forming device 101, and a central processing unit (CPU) 113 to control the programs 117 and 119 in the program memory 118, and the monitor 116 to display the created documents.

The image-forming device 101 such as a laser beam printer has the interface unit 170 to connect to the computer 112 for data exchanges, an operation panel 141 to enable a user to input commands or selections, a program memory 120 to store various control programs necessary to drive the image-forming device 101, and a data memory 130 to store various data occurring during the execution of the control programs and print data sent from the computer 112 through the interface unit 170. The image forming device further includes a printer controller 111 to execute the control programs to control the overall operation of the printer, a printer engine 160 controlled by the printer controller 111 to substantially print the print data on a paper, a data controller 123 to output the print data sent through the interface unit 170 to the printer engine 160, and a toner consumption amount calculation unit 103 according to the embodiment of the present invention to calculate the consumed amount of toner.

The program memory 120 includes nonvolatile flash memories from or to which software deletes or writes data by sector, and the data memory 130 includes RAMs which are volatile memories to allow data to be written or deleted.

The printer engine 160 generates and applies a video clock (VCLK) and a print synchronization signal (PSYNC) to a data converter 127 of the data controller 123.

The data controller 123 has a data buffer controller 125, a clock generator 145, and the data converter 127.

The data buffer controller 125 stores print data sent from the computer 112 to the data memory 130 through the interface unit 170 according to the video clock and the PSYNC applied from the printer engine 160, and, at the same time, outputs the print data to the data converter 127.

The data converter 127 inputs the print data outputted from the data buffer controller 125, and outputs the input print data to the printer engine 160 as video data (VD) by bit according to the VCLK and the PSYNC.

A clock generator 145 receives the VCLK from the printer engine 160 and generates a clock to request print data to the computer 112.

The toner consumption amount calculation unit 103 has a valid signal generator 135 such as an AND gate to receive the print data output from the data buffer controller 125 and the video clock VCLK of the printer engine 160 to synchronize the print data and generate binary image data. The binary image data includes a valid count signal of '0' or '1' wherein '0' indicates a pixel of an actual image not to be printed on a sheet of paper and '1' indicates a pixel of the image to be printed by use of toner. The toner consumption amount calculation unit 103 further includes a pixel counter 140 to count 1's of the valid count signal of the generated binary image data and calculate the number of pixels of the print data, a data stream counter 138 to calculate the number of particular data streams such as "101" or "1001" from the valid count signal of the generated binary image data, a coefficient memory 122 to store coefficients as to average toner consumption amounts per pixel and a weight memory 121 to store a lookup table containing weights as to toner consumption amounts depending on the particular data streams. The coefficient memory 122 and the weight memory 121 are installed in the program memory 120. The toner consumption amount calculation unit 103 further includes a printer controller 111 to calculate a consumed amount of toner with a number of pixels, an average toner consumption amount, and the weights according to the number of particular data streams, which are calculated with respect to one page of copies whenever each copy is printed.

Figure 2:
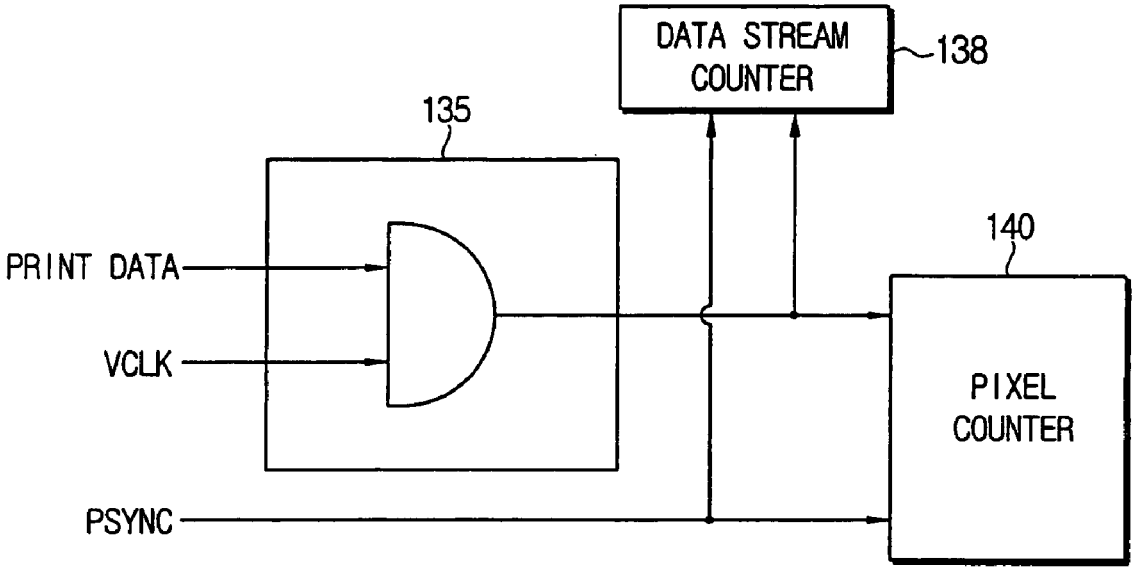
FIG. 2 is a block diagram showing a valid signal generator of the device to calculate a consumed amount of toner as shown in FIG. 1.
Figure 3:
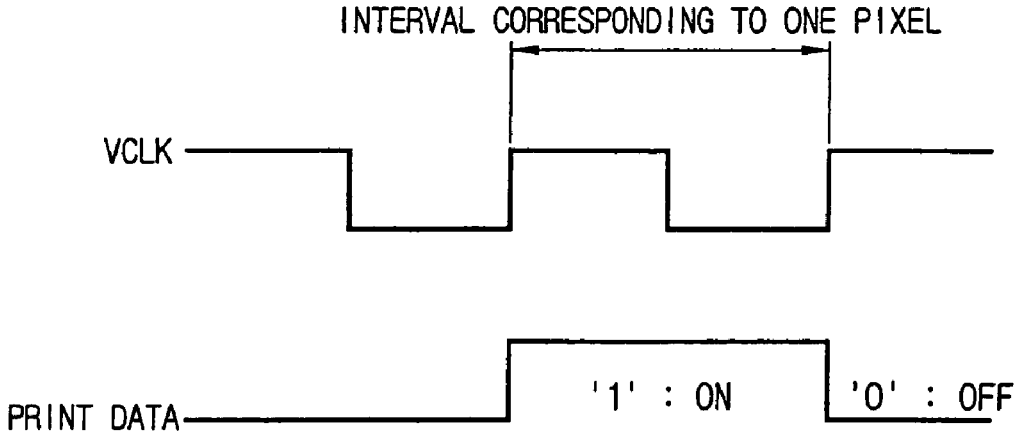
FIG. 3 is a view showing waveforms of a print data signal and a video data synchronization signal that are input to the valid signal generator of the device to calculate a consumed amount of toner as shown in FIG. 2.

As shown in FIG. 2 and FIG. 3, the valid signal generator 135 constructed with the AND gate generates binary image data including valid count signals having values of '0' or '1' in one video clock when print data for one pixel is input from the data buffer controller 125.

Of the valid count signal having the values of '0' or '1' forming the binary image data output from the valid signal generator 135, the pixel counter 140 counts 1's indicating pixels to be printed on a sheet of paper as parts of actual images, that is, counts the number of pixels, and outputs a pixel count signal to the printer controller 111.

Further, three or four buffers (not shown) are used for the binary image data output from the valid signal generator 135, and the data stream counter 138 stores current binary image data and preceding binary image data in the respective buffers, counts the numbers of one or more data streams such as "101" or "1001" in the binary image data, and outputs a data stream count signal to the printer controller 111.

The coefficient memory 122 stores a preset coefficient of an average toner consumption amount per pixel. The coefficient of an average toner consumption amount per pixel is the optimum value obtained through repetitive experiments of dividing an actually consumed amount of toner by the total number of pixels after a printer is set to a factory default value of printed images of varied patterns under various conditions of room temperature and humidity.

The weight memory 121 stores a lookup table containing weights depending on percentages of the total pixels to particular data streams. The particular data stream is either "101" or "1001", and, if a data stream to be printed or copied is "111" or "1111", the data stream is frequently changed to the above particular data stream in image processing procedures.

A weight increases corresponding to the number of particular data streams as described above, which is because, when an image such as the above particular data stream is printed, pixels corresponding to the binary image data having the values of "0" are not reflected when the number of pixels is calculated. However, due to a reproductibility of one-dot white line and a fringe effect, the toner is actually consumed as if the image data has the value of "1". The above particular data streams of "101" and "1001" have different percentages, ink fringe effect, and one-dot white line depending on task modes and image patterns. Therefore, the particular data streams are separately calculated and applied according to the task mode.

Table 2 below shows the number of "101" data streams, by task mode and by image pattern to be printed, as a percentage with respect to the total pixels of one page of copies.

TABLE 2

| | 5% solid pattern | 5% character pattern | 5% halftone pattern |
|---|---|---|---|
| Print mode | 0.00008% | 0.00288% | 0.03682% |
| Photo copy mode | 0.22352% | 0.06098% | 0.02874% |

Table 2 shows that the print mode has the largest number of data streams of "101" and the lower-level photocopy mode of the copy modes has the largest number of data streams of "1011" in the solid pattern. The result corresponds to the consumed amounts of toner shown in Table 1 compared to the consumed amounts of toner of Table 1, and the differences between the consumed amounts of toner per pixel are caused by the data streams of "101" and "1001" occurring when being photocopied or printed.

Table 3 as below is a lookup table containing weights experimentally calculated based on the number of data streams of "101".

TABLE 3

| | Percentage of "101" data streams to total pixels | Weights |
|---|---|---|
| Print mode | 0%~0.03% | 1 |
| | Same or Over 0.03% | 1.1 |
| Photo copy mode | 0~0.05% | 1.1 |
| | 0.05%~0.1% | 1.3 |
| | Same or Over 0.1% | 1.5 |

The printer controller 111 calculates the number of pixels and the number of particular data streams that are contained in one page of copies counted, reads a weight corresponding to the percentages of particular data streams of the pixels from the lookup table stored in the weight memory 121, and performs multiplication together with toner consumption amount coefficients, to thereby calculate the consumed amount of toner.

The consumed amount of toner is calculated in Equation 1:

$$\text{Total consumed amount of toner}=(\text{total number of pixels})\times(\text{toner consumption amount coefficient})\times(\text{weight}) \quad \text{[Equation 1]}$$

Whenever printing is performed on a sheet of paper, the printer controller 111 calculates the number of pixels and the number of particular data streams on each page, calculates the consumed amount of toner on the page by applying toner consumption amount coefficients and weights, and accumulates the consumed amounts of toner on copies to calculate the total consumed amount of toner.

Further, the printer controller 111 subtracts the consumed amount of toner from the remaining amount of toner, and updates information on the remaining amount of toner. The printer controller 111 controls a liquid crystal display (LCD) 114, which will be later described, if the remaining amount of toner is less than a predetermined reference toner level, to display messages notifying of insufficient toner left in the cartridge.

The toner consumption amount calculation unit 103 further includes a display unit (not shown) to display the consumed amount of toner together with information on the remaining amount of toner based on a display signal of the printer controller 111.

The consumed amount of toner together with information on the remaining amount of toner can be displayed on the monitor 116 of the external computer 112.

In order to reduce the operation time and the load to the processor, an embodiment of the present invention can employ a method that calculates the percentages of particular data streams with respect to some lines on one copy rather than calculating the percentages of particular data patterns with respect to the total lines on the page as described above, and applies weights based on the percentages.

As described above, the toner consumption amount calculation unit 130 calculates particular data patterns resulting in differences in the consumed amounts of toner, and corrects the consumed amount of toner by use of optimum weights experimentally obtained in advance based on the number of particular patterns, to thereby enable the consumed amount of toner to be precisely calculated.

Figure 4:
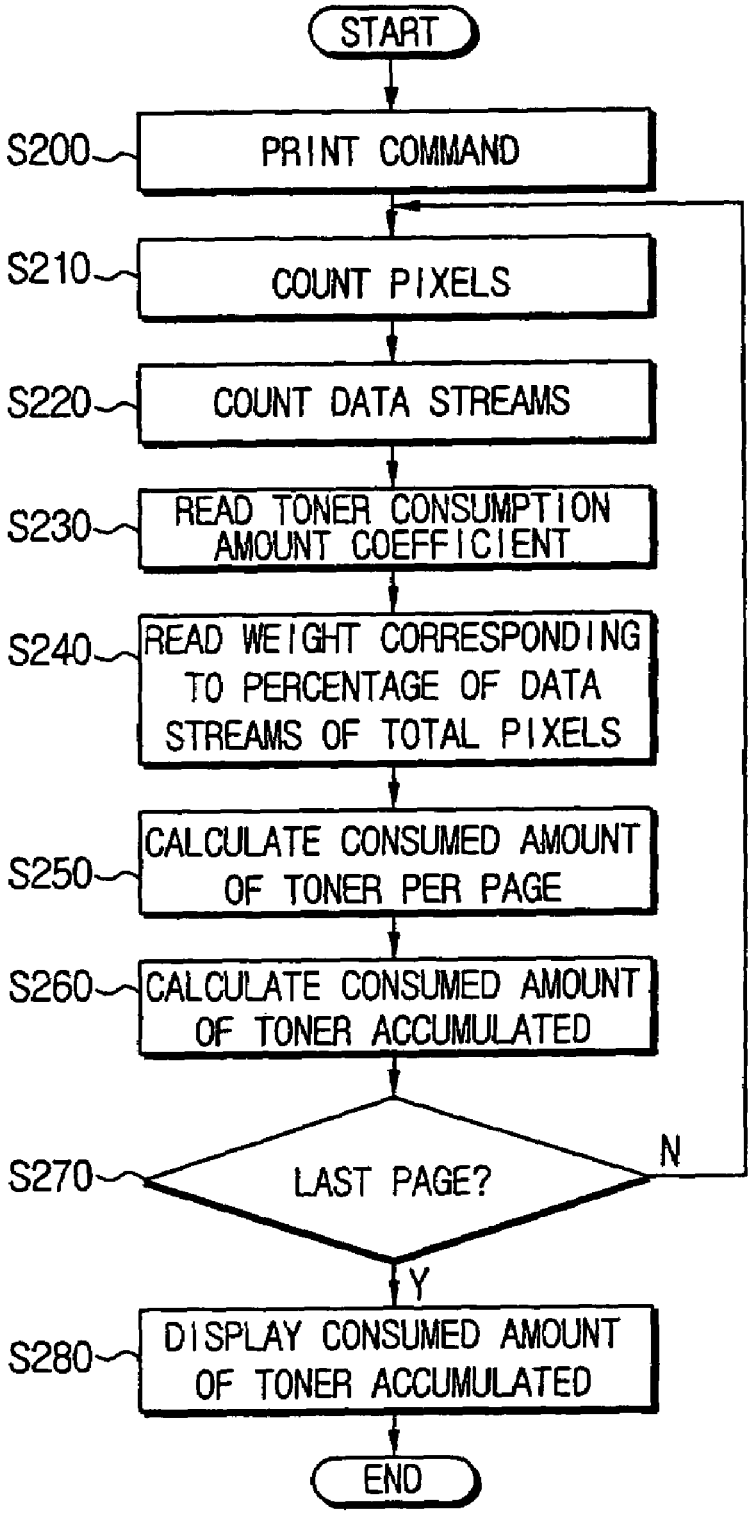
FIG. 4 is a flowchart for showing operations of the device to calculate a consumed amount of toner in the print system shown in FIG. 1.

FIG. 4 is a flowchart of the operations of the toner consumption calculation unit 103. Referring to FIG. 4, if the printer controller 111 sends a print command or a photocopy command to the printer engine 160 according to a user's input on the operation panel 141 or a command from the computer (S200), the printer engine 160 generates a PSYNC.

If the printer engine 160 generates the PSYNC signal, the data buffer controller 125 and the pixel counter 140 are reset, and the clock generator 145 generates a print data request clock.

With an input of the print data request clock of the clock generator 145, the data buffer controller 125 stores in the data memory 130 print data input in synchronization with the print data request clock, and then outputs the print data to the valid signal generator 135 and the data converter 127.

As the data buffer controller 125 outputs the print data, the data converter 127 outputs the print data bit by bit to the printer engine 160 as VD according to the VCLK and the PSYNC, and the printer engine 160 proceeds with printing by emitting onto a photosensitive body (not shown) laser beams corresponding to the VD through a laser diode of a laser scanning unit (not shown).

In here, as shown in FIG. 3, when the print data for one pixel is input, the valid signal generator 135 generates binary image data including a valid count signal having a value of "0" or "1" in the video clock.

The pixel counter 140 calculates the number of pixels printed on one copy based on the binary image data corresponding to the copy (S210), and the data stream counter 138 calculates the number of particular patterns such as data streams of "101" and "1001" based on the binary image data corresponding to one copy (S220).

Further, the printer controller 111 reads coefficients stored in the coefficient memory 122 (S230), wherein the coefficients each denote a consumed amount of toner per pixel.

At the same time, the printer controller 111 reads the weight in accordance with the percentage of the number of data streams with respect to the total pixels from a lookup table stored in the weight memory 121 (S240). The printer controller 111 reads out the weights based on information on the task mode to process an image, such as the print mode or the photocopy mode.

The printer controller 111 multiplies the number of pixels, toner consumption amount coefficients, and weights to calculate a consumed amount of toner over a current copy (S250).

Next, the printer controller 111 accumulates the consumed amount of toner calculated as to the current copy to the consumed amount of toner calculated as to the previously printed copies (S260), checks whether the current copy is the last one (S270), and, if there exist more pages of copies left to be printed or photocopied, repeats the operations after operation S210, and, if the current copy is the last copy, decides and displays on the LCD 114 or the monitor 116 the current amount of accumulated toner consumption amount as the amount of toner consumed to print or photocopy (S280).

The printer controller 111 checks if the current amount of toner, obtained by subtracting the consumed amount of toner from the remaining amount of toner, is less than a predetermined reference toner level, and, if less than the reference toner level, displays on the display units 114 and 116 messages notifying that the remaining toner is insufficient.

Therefore, the consumed amount of toner can be precisely calculated according to the above method.

As described above, since the embodiment of the present invention applies weights determined by use of the percentage of particular data streams verified through experiments directly related to the actual toner consumption amounts, the embodiment of the present invention can more precisely calculate a consumed amount of toner.

Further, the embodiment of the present invention can more precisely provide the remaining amount of toner, enabling a user to timely replace toner cartridges, to thereby save toner and enhance print quality.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A device to calculate a consumed amount of toner in an image-forming apparatus, comprising:

a valid signal generator to input print data and a video clock (VCLK) signal to synchronize the print data, and generate binary image data;

a pixel counter to calculate a number of pixels of the print data based on the binary image data;

a data stream counter to calculate a number of particular data streams of the binary image data, a particular data stream having a most significant and a least significant bit of "1" and a bit of "0";

a coefficient memory to store coefficients with respect to average toner consumption amounts per pixel;

a weight memory to store a lookup table containing weights corresponding to percentages of the number of pixels relative to the number of the particular data streams; and a controller to calculate a percentage of the number of pixels relative to the number of particular data streams to read out a weight, and calculate the consumed amount of toner by use of the read weight, the number of pixels, and the stored coefficient with respect to average toner consumption amount per pixel corresponding to the print data.

2. The device as claimed in claim 1, wherein the lookup table contains weights individually calculated corresponding to an image-processing mode including a print mode or a photocopy mode, and the controller decides the image-processing mode corresponding to the current print data, applies a corresponding weight, and calculates the consumed amount of toner.

3. The device as claimed in claim 1, wherein the particular data stream is any one of "101" and "1001", and the read weight increases in proportion to the percentage of the number of pixels relative to the number of the particular data streams.

4. The device as claimed in claim 1, wherein the data stream counter calculates the number of particular data streams based on parts of the binary image data that are spaced in a predetermined interval in order to reduce a time to calculate a ratio of the particular data streams, and the controller calculates the ratio of the particular data streams based on the parts of the binary image data spaced in the interval.

5. The device as claimed in claim 1, wherein the pixel counter calculates the number of pixels based on a number of bits of the binary image data of "1".

6. The device as claimed in claim 1, wherein the bit of "0" is between the most and least significant bits.

7. The device as claimed in claim 1, wherein the valid signal generator is an AND gate.

8. The device as claimed in claim 1, wherein the particular data stream is any one of "101" and "1001", and the read weight is related to an image pattern of the print data.

9. The device as claimed in claim 8, wherein the image pattern is a solid pattern, a character pattern, or a halftone pattern.

10. The device as claimed in claim 1, wherein the consumed amount of toner T is calculated according to T=(calculated number of pixels)×(toner consumption amount coefficient per pixel)×(read weight).

11. The device as claimed in claim 1, wherein the stored coefficient corresponding to the print data corresponds to a mode of the image forming apparatus.

12. The device as claimed in claim 11, wherein the mode is a photo copy mode or a print mode.

13. A method of calculating a consumed amount of toner in an image-forming apparatus, comprising:

storing coefficients with respect to average toner consumption amounts per pixel;

storing a lookup table containing weights corresponding to percentages of a number of pixels to particular data streams of binary image data, the particular data streams each having a most significant and a least significant bit of "1" and a bit of "0", the binary image data being binary data converted from print data;

inputting the print data and a video clock to synchronize the print data, and generating the binary image data;

calculating the number of pixels of the print data based on the binary image data;

calculating a number of the particular data streams of the binary image data; and calculating a percentage of the number of pixels relative to the number of particular data streams to read out a weight, and calculating the consumed amount of toner with the read weight, the number of pixels, and the stored coefficient with respect to average toner consumption amount per pixel corresponding to the print data.

14. The method as claimed in claim 13, wherein the weight lookup table contains weights individually calculated corresponding to an image-processing mode including a print mode or a photocopy mode, and the toner consumption amount calculation comprises deciding the image-processing mode corresponding to the current print data, and calculates a corresponding weight.

15. The method as claimed in claim 13, wherein the particular data stream is "101" or "1001", and the weight increases in proportion to the number of the particular data streams.

16. The method as claimed in claim 13, further comprising calculating the number of particular data streams based on parts of the binary image data that are spaced in a predetermined interval, wherein the calculating of the consumed amount of toner comprises calculating the percentage of the particular data streams based on the parts of the binary image data spaced in the interval.

17. A device to calculate a consumed amount of toner in an apparatus to form an image from binary image data, comprising:

a pixel counter to calculate a number of pixels based on the binary image data;

a data stream counter to calculate a number of data streams of the binary image data; and a controller to calculate a percentage of the number of pixels relative to the number of data streams to thereby read out a stored weight, and calculate the consumed amount of toner with the read weight, the calculated number of pixels, and a stored toner consumption amount coefficient per pixel, wherein the data streams are "101" or "1001".

18. An apparatus comprising:

an image former to form an image with toner based upon binary image data; and a calculator to calculate a consumed amount of the toner, comprising:

a pixel counter to calculate a number of pixels based on the binary image data, a data stream counter to calculate a number of data streams of the binary image data, and a controller to calculate a percentage of the number of pixels relative to the number of data streams to thereby read out a stored weight, and calculate the consumed amount of toner with the read weight, the calculated number of pixels, and a stored toner consumption amount coefficient per pixel, wherein the data streams are "101" or "1001".

* * * * *